US012188481B1

(12) United States Patent
Li

(10) Patent No.: US 12,188,481 B1
(45) Date of Patent: Jan. 7, 2025

(54) FAN BLADE

(71) Applicant: Shenzhen Ruisimai Technology Co., Ltd., Shenzhen (CN)

(72) Inventor: Hong Li, Shenzhen (CN)

(73) Assignee: Shenzhen Ruisimai Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/398,096

(22) Filed: Dec. 27, 2023

(30) Foreign Application Priority Data

Dec. 7, 2023 (CN) ..... 202323349361.0

(51) Int. Cl.
*F04D 29/28* (2006.01)
*F04D 17/00* (2006.01)

(52) U.S. Cl.
CPC ..... *F04D 29/281* (2013.01); *F04D 17/00* (2013.01)

(58) Field of Classification Search
CPC ..... F04D 29/281; F04D 17/00
See application file for complete search history.

(56) References Cited

U.S. PATENT DOCUMENTS 7,201,565 B2 * 4/2007 Ku ..... F04D 29/329 416/175
7,207,779 B2 * 4/2007 Horng ..... F04D 29/283 416/186 R
2016/0138614 A1 * 5/2016 Fuchibe ..... F04D 29/282 416/144

FOREIGN PATENT DOCUMENTS

CN 204122999 U 1/2015
CN 208606664 U 3/2019
CN 216044613 U 3/2022

* cited by examiner

*Primary Examiner* — Sabbir Hasan
(74) *Attorney, Agent, or Firm* — Nitin Kaushik

(57) ABSTRACT

The present disclosure relates to a fan blade, including a wheel hub, a bottom plate and a plurality of blades. The plurality of blades encircle an outer peripheral side of the wheel hub at an interval; a separation distance is kept between each of the blades and the wheel hub; the wheel hub, the bottom plate and the blades enclose an annular groove; an air guide groove is formed between two adjacent blades; a first air inlet is formed in a side, away from the bottom plate, of the air guide groove; a second air inlet connected to the annular groove is formed in a side, close to the wheel hub, of the air guide groove; and an air outlet is formed in a side, away from the wheel hub, of the air guide groove.

13 Claims, 14 Drawing Sheets

FAN BLADE

CROSS-REFERENCE TO RELATED APPLICATIONS

The application claims priority to Chinese patent application No. 2023233493610, filed on Dec. 7, 2023, the entire contents of which are incorporated herein by reference.

TECHNICAL FIELD

The present disclosure belongs to the technical field of fans, and particularly relates to a fan blade.

BACKGROUND

A fan usually refers to a heat dissipating device such as a neck fan and a handheld fan. The fan usually includes fan blades and a motor. The fan blades include a wheel hub, a bottom plate and a plurality of blades. The wheel hub is arranged on the bottom plate. The blades all are connected to the bottom plate and the wheel hub. The motor drives the wheel hub to rotate, so that the wheel hub drives the blades to rotate. The blades rotate to suck air into an air guide groove and then blow the air outlet to generate an air flow. The air flow takes away heat to achieve a heat dissipating purpose.

However, in a conventional fan blade, because the blades all are connected to the bottom plate and the wheel hub, there is only one air inlet of the air guide groove to supply air, resulting in a small supply air rate and a low air intake efficiency when the fan blade rotates.

SUMMARY

To overcome defects in the prior art, the present disclosure provides a fan blade which uses double air inlets, so that the supply air rate and the air intake efficiency can be improved when the fan blade rotates.

In order to achieve the above object, the present disclosure adopts the following technical solution;

A fan blade, including a wheel hub, a bottom plate and a plurality of first blades, where the wheel hub is connected to the bottom plate; a lower end of each of the first blades is connected to an upper surface of the bottom plate; the first blade extends parallel to an axis direction of the wheel hub; the plurality of first blades encircle an outer peripheral side of the wheel hub at an interval; a separation distance is kept between each of the first blades and the wheel hub; an outer peripheral side wall of the wheel hub, the upper surface of the bottom plate, and an end, close to the wheel hub, of the first blade form an annular groove; a first air guide groove is formed between two adjacent first blades; a side, away from the bottom plate, of the first guide air groove is opened to form a first air inlet; a side, close to the wheel hub, of the first air guide groove is opened to form a second air inlet; the second air inlet is connected to the annular groove; and a side, away from the wheel hub, of the first air guide groove is opened to form a first air outlet. When the fan blade rotates, air flows into the first air guide groove from the first air inlet and the second air inlet and flows out from the first air outlet. By using the double air inlets, the supply air rate of the fan blade is improved, and the air intake efficiency is higher.

In an embodiment of the present disclosure, the bottom plate includes a flat plate and an inclined plate, an upper end of the inclined plate being connected to the wheel hub and a lower end of the inclined plate being connected to the flat plate.

In an embodiment of the present disclosure, the bottom plate is a single inclined plate or arc-shaped plate.

In an embodiment of the present disclosure, aside, close to the wheel hub, at atop end of the first blade is provided with an air guide inclined plane formed by an unfilled corner, and the air guide inclined plane extends toward a direction close to the wheel hub from top to bottom.

In an embodiment of the present disclosure, the air guide inclined plane extends to the bottom plate from the top end of the first blade.

In an embodiment of the present disclosure, a separation distance between the first blade and the wheel hub is 1.0-4.0 mm.

In an embodiment of the present disclosure, the fan blade further includes a connecting ring, the connecting ring being connected to a side, away from the wheel hub, at the top end of the first blade.

A fan blade, including a wheel hub, a plurality of first blades and a plurality of second blades, where the plurality of first blades encircle an outer peripheral side of the wheel hub at an interval, a first air guide groove is formed between two adjacent first blades, and the first air guide groove is opened in an axis direction of the wheel hub to form a first air inlet; the plurality of second blades are annularly distributed at an interval on an upper end surface of the wheel hub, a second air guide groove is formed between two adjacent second blades, and a side, away from the upper end surface of the wheel hub, of the second air guide groove is opened to form a third air inlet; and a side, away from the wheel hub, of the first air guide groove is opened to form a first air outlet, and a side, close to each of the first blades, of the second air guide groove is opened to form a second air outlet.

In an embodiment of the present disclosure, a quantity of the first blades is ≥a quantity of the second blades.

In an embodiment of the present disclosure, an end, close to each of the first blades, of each of the second blades does not protrude out of an outer peripheral side wall of the wheel hub.

In an embodiment of the present disclosure, a separation distance is kept between an end, away from the first blade, of the second blade and a central axis of the wheel hub.

In an embodiment of the present disclosure, an upper end surface of the first blade protrudes out of the upper end surface of the wheel hub.

In an embodiment of the present disclosure, the first blade and the second blade both are arc-shaped blades, and bending directions of the first blade and the second blade are same.

In an embodiment of the present disclosure, a width of the second air guide groove increases gradually from inside to outside.

In an embodiment of the present disclosure, the first blade is connected to the outer peripheral side wall of the wheel hub, and both sides of the first air guide groove in the axis direction of the wheel hub both are opened to form the first air inlets.

In an embodiment of the present disclosure, the fan blade further includes a bottom plate, where a lower end of the wheel hub is connected to the bottom plate; a lower end of the first blade is connected to an upper surface of the bottom plate, and the first blade is connected to the outer peripheral side wall of the wheel hub; and the side, away from the bottom plate, of the first air guide groove is opened to form the first air inlet.

In an embodiment of the present disclosure, the fan blade further includes a bottom plate, where a lower end of the wheel hub is connected to the bottom plate; a bottom end of the first blade is connected to an upper surface of the bottom plate; a separation distance is kept between the first blade and the wheel hub; a side, away from the bottom plate, of the first air guide groove is opened to form the first air inlet; an outer peripheral side wall of the wheel hub, the upper surface of the bottom plate and an end, close to the wheel hub, of the first blade enclose an annular groove; a side, close to the wheel hub, of the first air guide groove is opened to form a second air inlet; and the second air inlet is connected to the annular groove.

In an embodiment of the present disclosure, the bottom plate includes a flat plate and an inclined plate, an upper end of the inclined plate being connected to the wheel hub and a lower end of the inclined plate being connected to the flat plate.

In an embodiment of the present disclosure, the bottom plate is a single inclined plate or arc-shaped plate.

In an embodiment of the present disclosure, a center of circle of an annular structure enclosed by the first blades and a center of circle of an annular structure enclosed by the second blades are on a same axis.

Compared with the prior art, the present disclosure has the prominent advantages and beneficial effects specifically as follows: the separation distance is kept between each of the first blades and the wheel hub, so that the outer peripheral side wall of the wheel hub, the upper surface of the bottom plate, and the end, close to the wheel hub, of the first blade form the annular groove; the side, away from the bottom plate, of the first guide air groove is opened to form the first air inlet; the side, close to the wheel hub, of the first air guide groove is opened to form the second air inlet; the second air inlet is connected to the annular groove; and the side, away from the wheel hub, of the first air guide groove is opened to form the first air outlet. When the fan blade rotates, air flows into the first air guide groove from the first air inlet and the second air inlet and flows out from the first air outlet. By using the double air inlets, the supply air rate of the fan blade is improved, and the air intake efficiency is higher.

In order to explain structural features, technical means and specific purposes and functions achieved thereby, the present disclosure will be further described in detail below in combination with drawings and specific embodiments.

10—wheel hub; 11—annular groove; 12—magnet frame accommodation groove;

121—mounting opening; 20—bottom plate; 21—flat plate;

22—inclined plate; 30—first blade; 31—first air guide groove;

32—first air inlet; 33—second air inlet; 34—first air outlet;

35—air guide inclined plane; 40—second blade; 41—second air guide groove;

42—third air inlet; 43—second air outlet; 50—first connecting ring.

DETAILED DESCRIPTION OF THE EMBODIMENTS

In description of the present disclosure, it is to be noted that orientation or position relationships indicated by the terms: "central", "upper", "lower". "left", "right", "vertical", "horizontal', "inner", "outer" and the like are orientation or position relationships indicated by the drawings and are only to describe the present disclosure and simplify the description rather than indicates or implies that the indicated positions or components must have specific orientations and are configured and operated in the specific orientations. Therefore, it cannot be construed as limitations to the present disclosure.

In the description of the present disclosure, it is to be noted that, unless otherwise explicitly specified and defined, the terms "mounting", "connecting" and "connection" should be understood in a broad sense, for example, they may be a fixed connection, a detachable connection, or an integrated connection; may be a mechanical connection, or an electrical connection; and may be a direct connection, or an indirect connection via an intermediate medium, or communication inside two components. Those of ordinary skill in the art may understand the specific meanings of the foregoing terms in the present disclosure according to specific situations.

Figure 1:
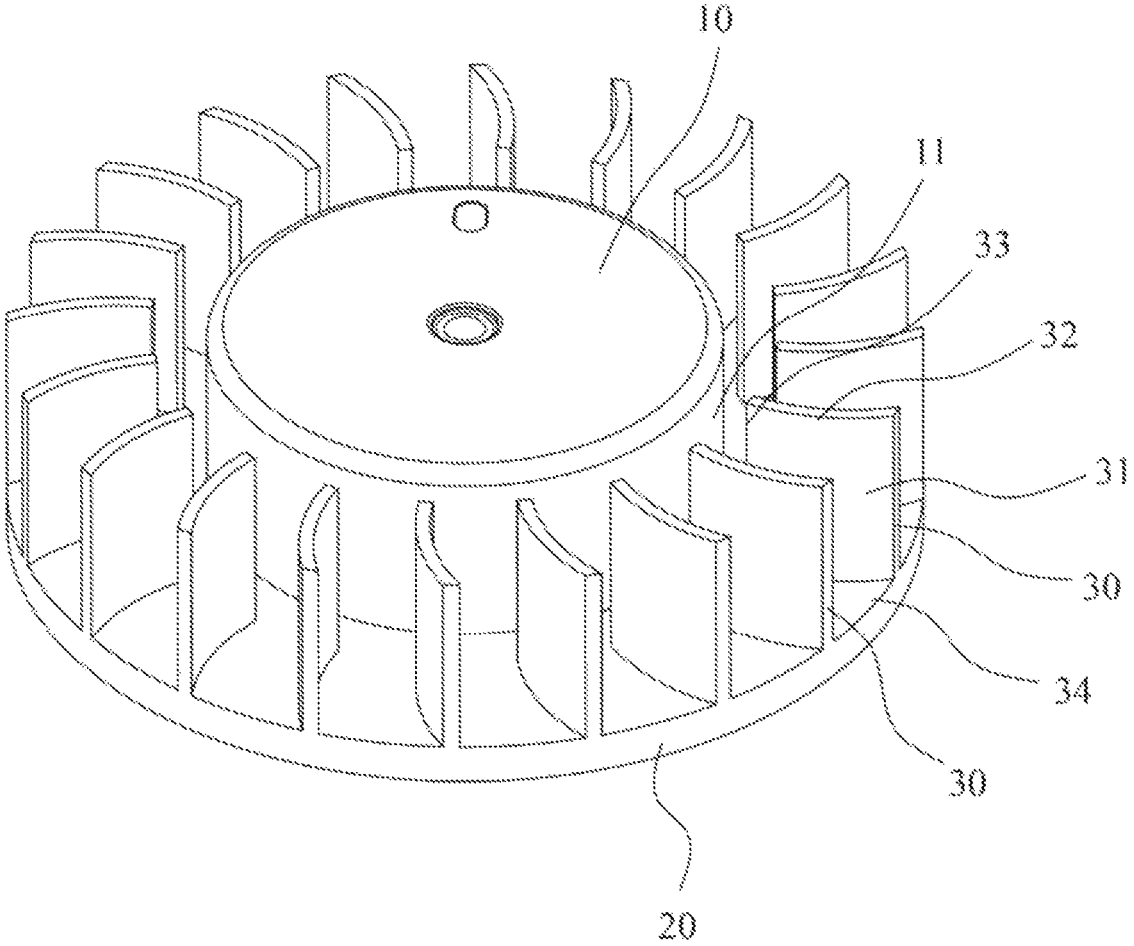
FIG. 1 is a schematic structural diagram of a first embodiment of the present disclosure.
Figure 2:
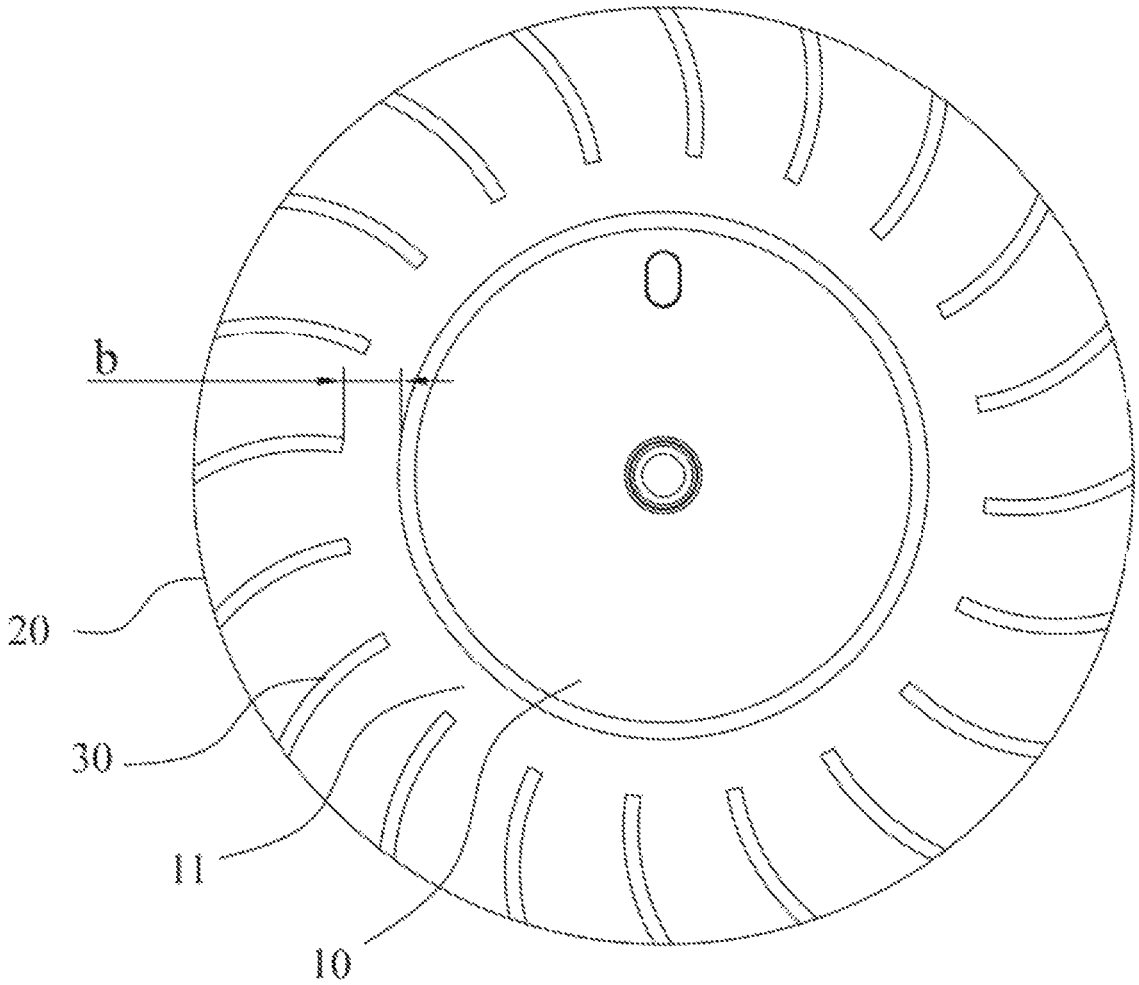
FIG. 2 is a top view of the first embodiment of the present disclosure.
Figure 3:
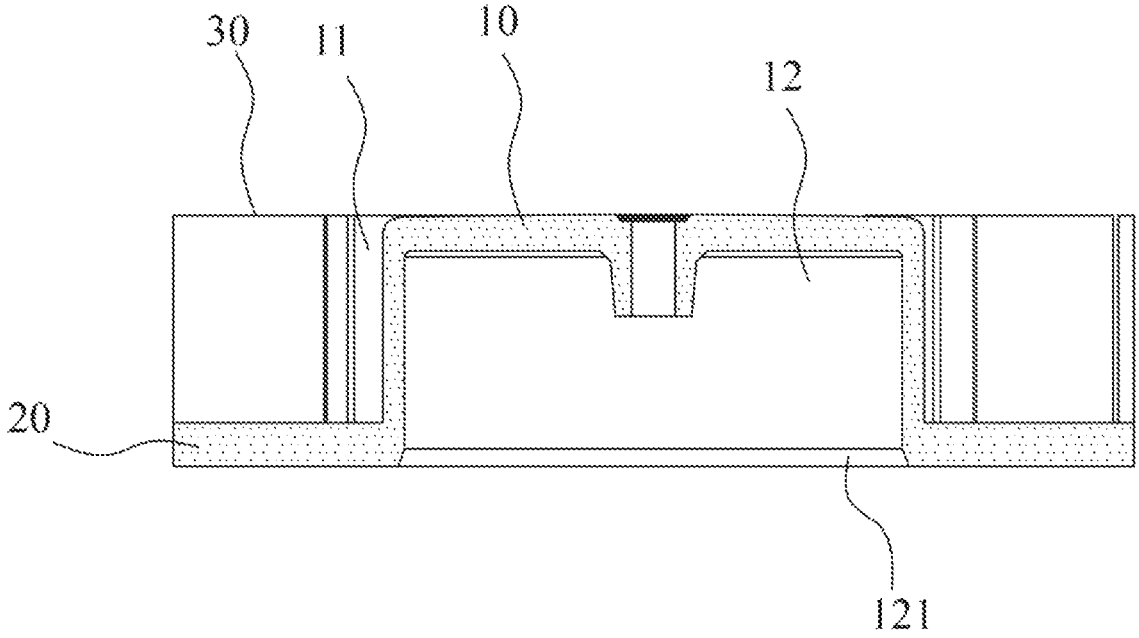
FIG. 3 is a sectional view of the first embodiment of the present disclosure.

As shown in FIGS. 1-3, the present disclosure relates to a fan blade. In a first embodiment, the fan blade includes a wheel hub 10, a bottom plate 20 and a plurality of first blades 30, where the wheel hub 10 is connected to the bottom plate 20; the bottom plate 20 is a single flat bottom plate 20; a lower end of each of the first blades 30 is connected to an upper surface of the bottom plate 20; the first blade 30 extends parallel to an axis direction of the wheel hub 10; the plurality of first blades 30 encircle an outer peripheral side of the wheel hub 10 at an interval; a separation distance is kept between each of the first blades 30 and the wheel hub 10; a the separation distance b between the first blade 30 and the wheel hub 10 is 1.0-4.0 mm, and preferably, the separation distance b is 2.0-3.0 mm; an outer peripheral side wall of the wheel hub 10, the upper surface of the bottom plate 20, and an end, close to the wheel hub 10, of the first blade 30 form an annular groove 11; a first air guide groove 31 is formed between two adjacent first blades 30; a side, away from the bottom plate 20, of the first guide air groove 31 is opened to form a first air inlet 32; a side, close to the wheel hub 10, of the first air guide groove 31 is opened to form a second air inlet 33; the second air inlet 33 is connected to the annular groove 11; and a side, away from the wheel hub 10, of the first air guide groove 31 is opened to form a first air outlet 34.

A magnet frame accommodation groove 12 is arranged in the wheel hub 10; the lower end of the wheel hub 10 is provided with a mounting opening 121 connected to the magnet frame accommodation groove 12; an end, close to the mounting opening 121, of the wheel hub 10 is connected to the bottom plate 20; and the first blade 30 extends towards an opened direction of the mounting opening 121 parallel to the axis direction of the wheel hub 10 from the upper surface of the bottom plate 20.

Figure 4:
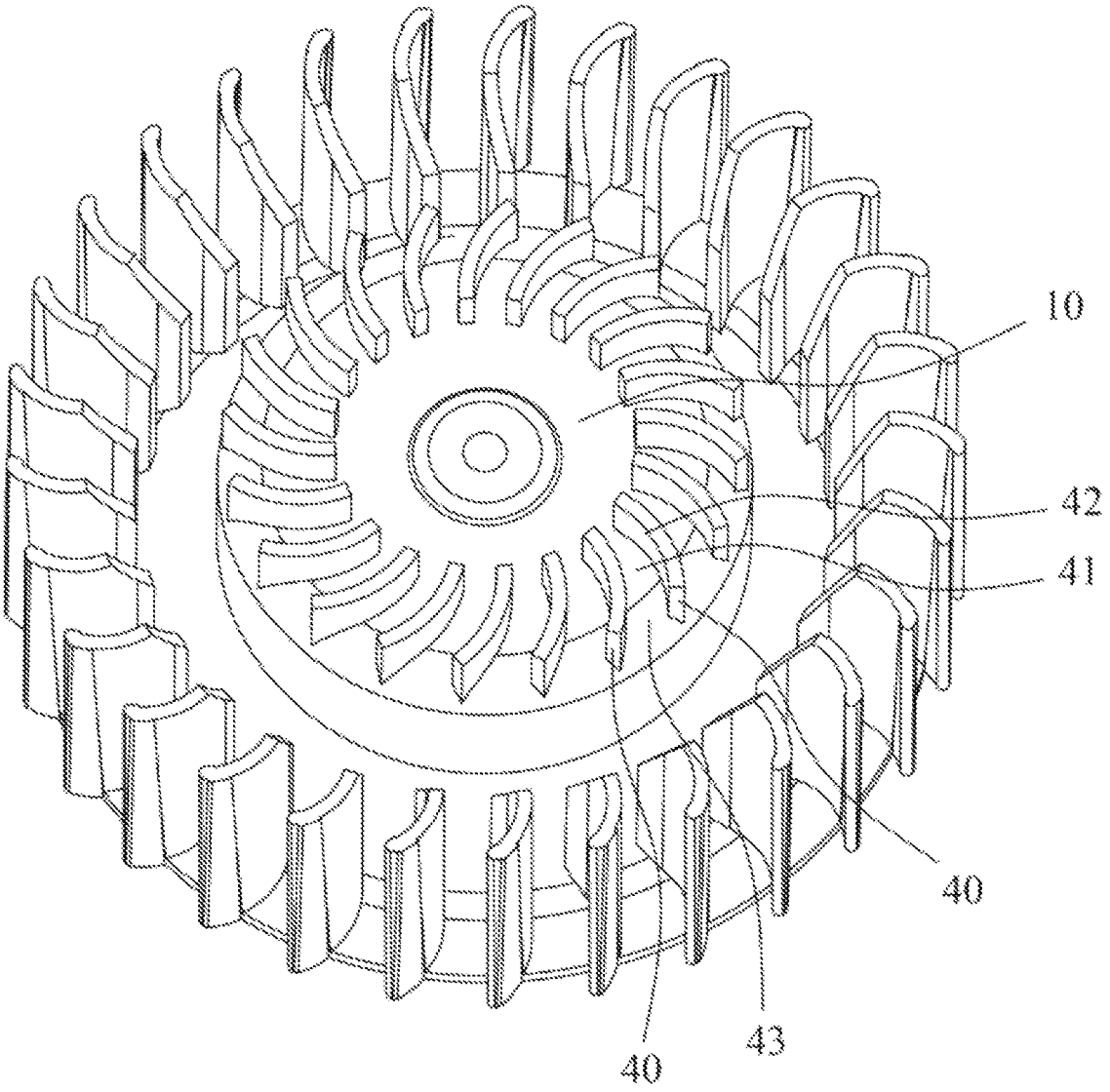
FIG. 4 is a schematic structural diagram of a second embodiment of the present disclosure.
Figure 5:
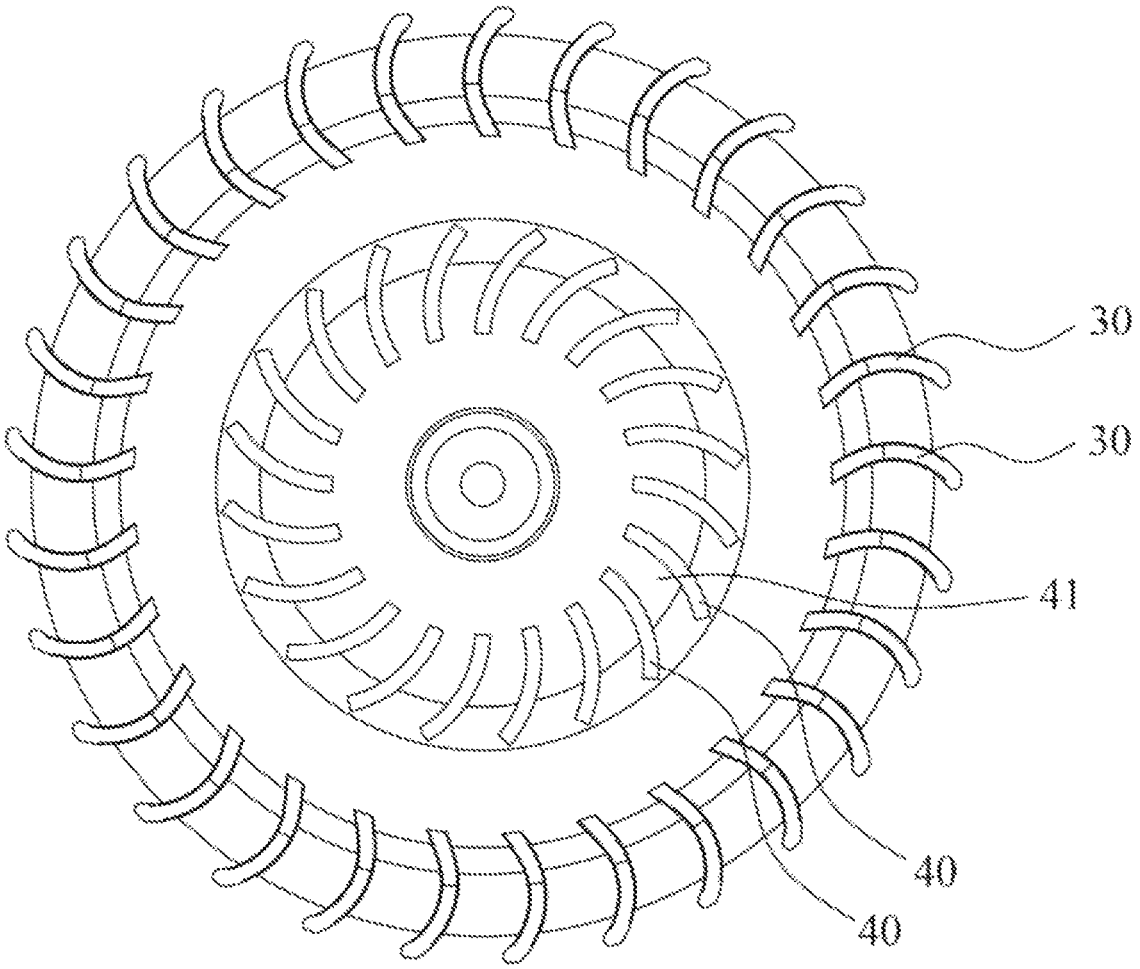
FIG. 5 is a top view of the second embodiment of the present disclosure.
Figure 6:
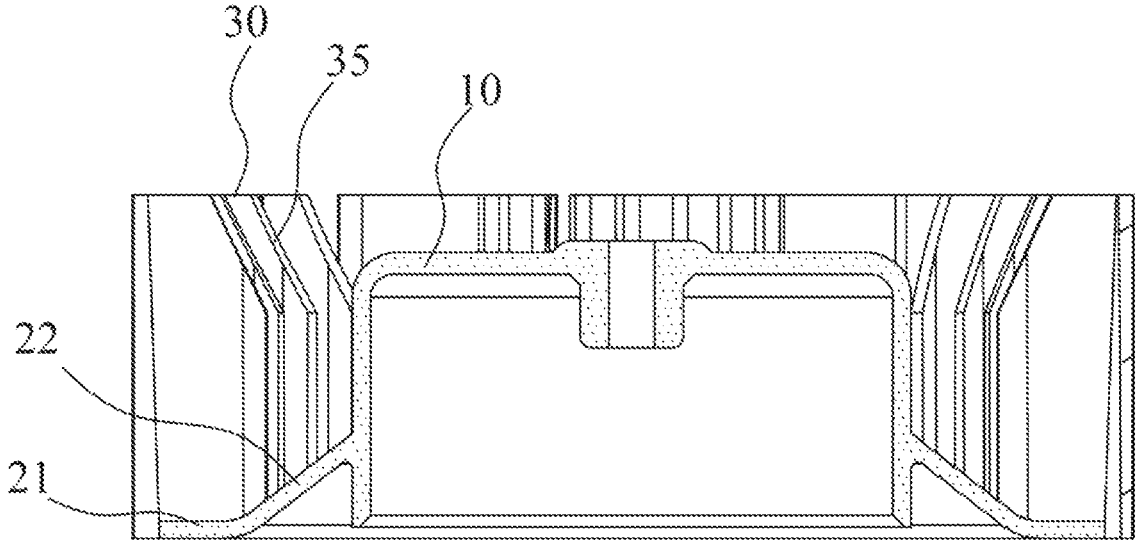
FIG. 6 is a sectional view of the second embodiment of the present disclosure.

As shown in FIGS. 4-6, in a second embodiment, the difference between the second embodiment and the first embodiment lies in that the fan blade further includes a plurality of second blades 40, where the plurality of second blades 40 are annularly distributed at an interval on an upper end surface of the wheel hub 10; a second air guide groove 41 is formed between two adjacent second blades 40; a side, away from the upper end surface of the wheel hub 10, of the second air guide groove 41 is opened to form a third air inlet 42; and a side, close to each of the first blades 30, of the second air guide groove 41 is opened to form a second air outlet 43; by arranging the annularly distributed second blades 40 at an interval on the upper end surface of the wheel hub 10, forming the second air guide groove 41 between the two adjacent second blades 40 and forming the third air inlet 42 and the second air outlet 43 in the second air guide groove 41, when the fan blade rotates, the first blades 30 and the second blades 40 both gather air, so that the air supply rate of the fan blade is greater and the air intake efficiency is higher.

A quantity of the first blades 30 is ≥a quantity of the second blades 40.

An end, close to each of the first blades 40, of each of the second blades 30 does not protrude out of an outer peripheral side wall of the wheel hub 10.

A separation distance is kept between an end, away from the first blade 30, of the second blade 40 and a central axis of the wheel hub 10.

An upper end surface of the first blade 30 protrudes out of the upper end surface of the wheel hub 10.

The first blade 30 and the second blade 40 both are arc-shaped blades, and bending directions of the first blade 30 and the second blade 40 are same. Specifically, the first blade 30 and the second blade 40 both are bent clockwise or the first blade 30 and the second blade 40 both are bent anticlockwise.

A width of the second air guide groove 41 increases gradually from inside to outside.

A side, close to the wheel hub 10, at a top end of the first blade 30 is provided with an air guide inclined plane 35 formed by an unfilled corner, and the air guide inclined plane 35 extends toward a direction close to the wheel hub 10 from top to bottom.

The bottom plate 20 includes a flat plate 21 and an inclined plate 22 integrally connected, where an upper end of the inclined plate 22 is connected to the wheel hub 10, and a lower end of the inclined plate 22 is connected to the flat plate 21. Specifically, the inclined plate 22 extends toward a direction, away from the wheel hub 10, from top to bottom.

It is to be noted that the bottom plate 20 in the present disclosure can also be arranged as a single inclined plate or arc-shaped plate. Specifically, the inclined plate extends toward a direction, away from the wheel hub 10, from top to bottom, and the arc-shaped plate is of an upward protruding structure or a downward sunken structure.

A center of circle of an annular structure enclosed by the first blades 30 and a center of circle of an annular structure enclosed by the second blades 40 are on a same axis.

Figure 7:
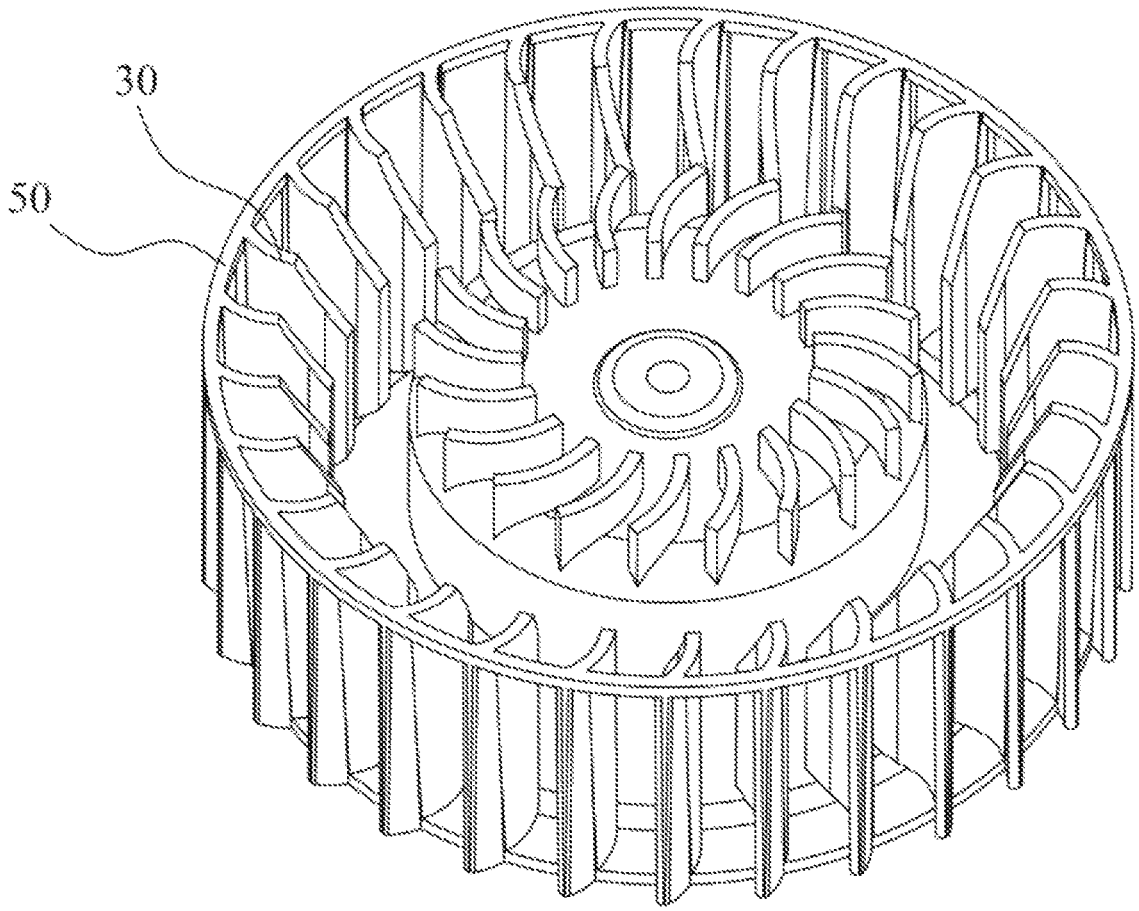
FIG. 7 is a schematic structural diagram of a third embodiment of the present disclosure.

As shown in FIG. 7, in a third embodiment, the difference between the third embodiment and the first and second embodiments lies in that the fan blade further includes a connecting ring 50, the connecting ring 50 being connected to a side, away from the wheel hub 10, at the top end of the first blade 30. Specifically, the connecting ring 50 is a round ring, and a central axis of the round ring and the central axis of the wheel hub 10 are coaxially arranged.

Figure 8:
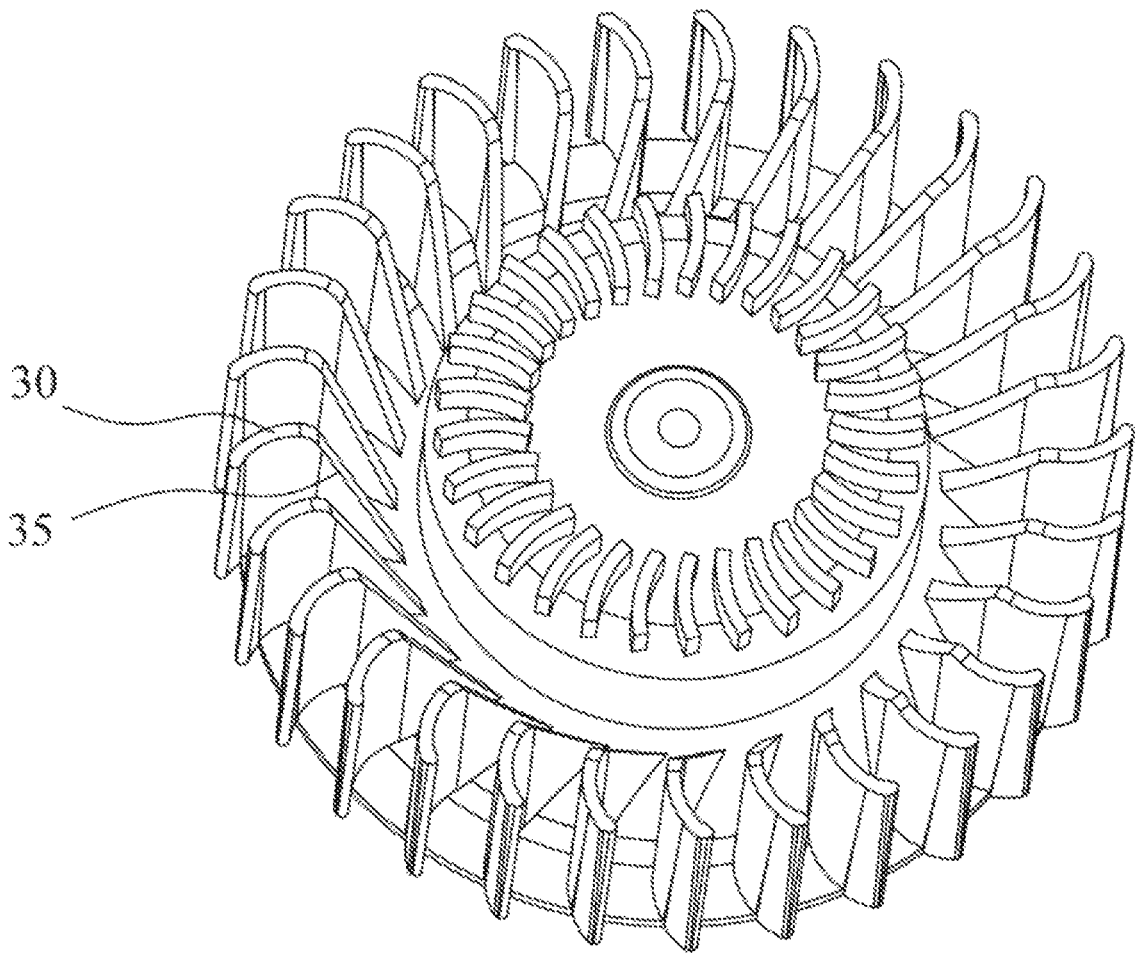
FIG. 8 is a schematic structural diagram of a fourth embodiment of the present disclosure.
Figure 9:
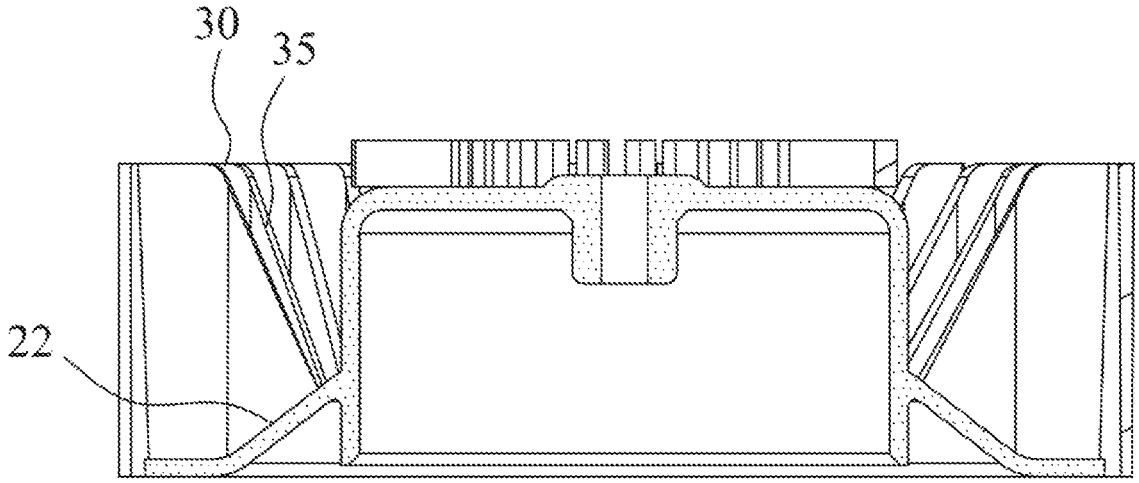
FIG. 9 is a sectional view of the fourth embodiment of the present disclosure.

As shown in FIGS. 8-9, in a fourth embodiment, the difference between the fourth embodiment and the first and second embodiments lies in that the air guide inclined plane 35 extends to the bottom plate 20 from the top end of the first blade 30.

Figure 10:
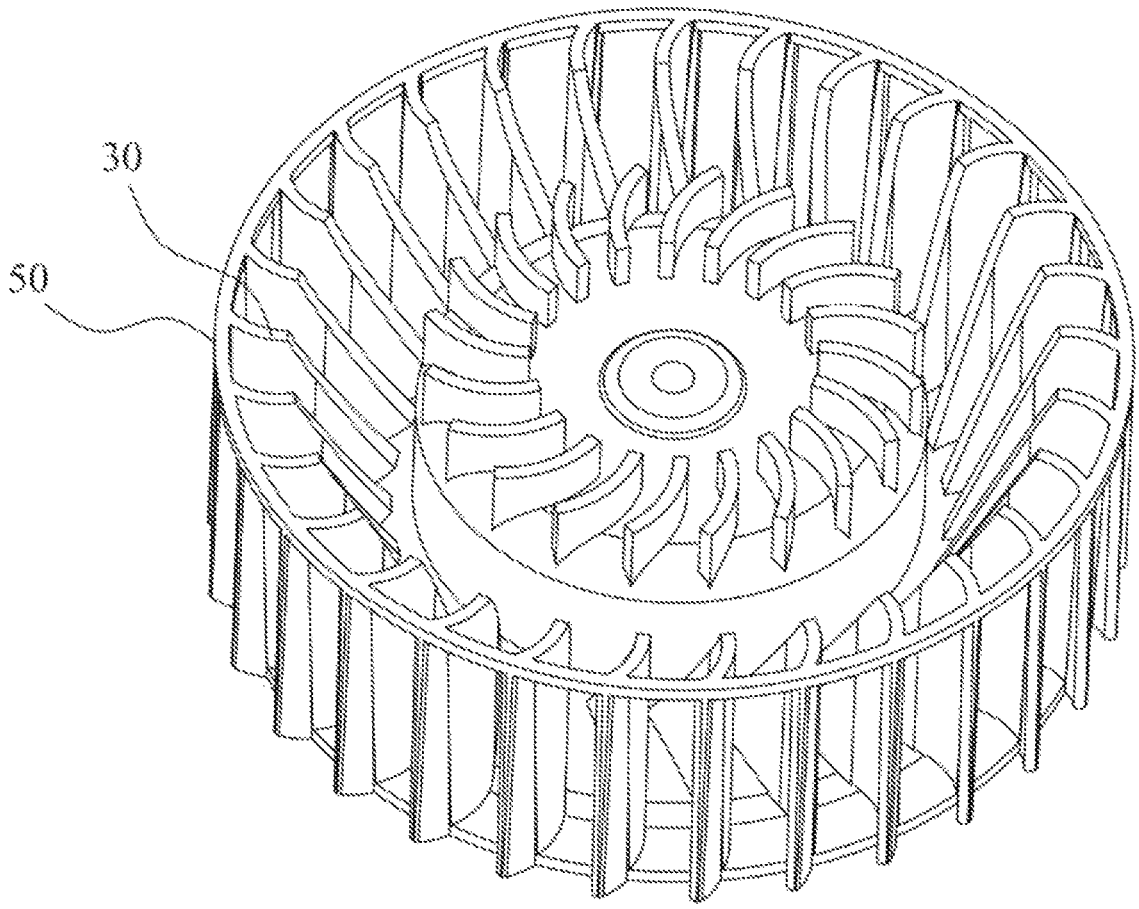
FIG. 10 is a schematic structural diagram of a fifth embodiment of the present disclosure.

As shown in FIG. 10, in a fifth embodiment, the difference between the fifth embodiment and the first and second embodiments lies in that the fan blade further includes a connecting ring 50, the connecting ring 50 being connected to aside, away from the wheel hub 10, at the top end of the first blade 30.

Figure 11:
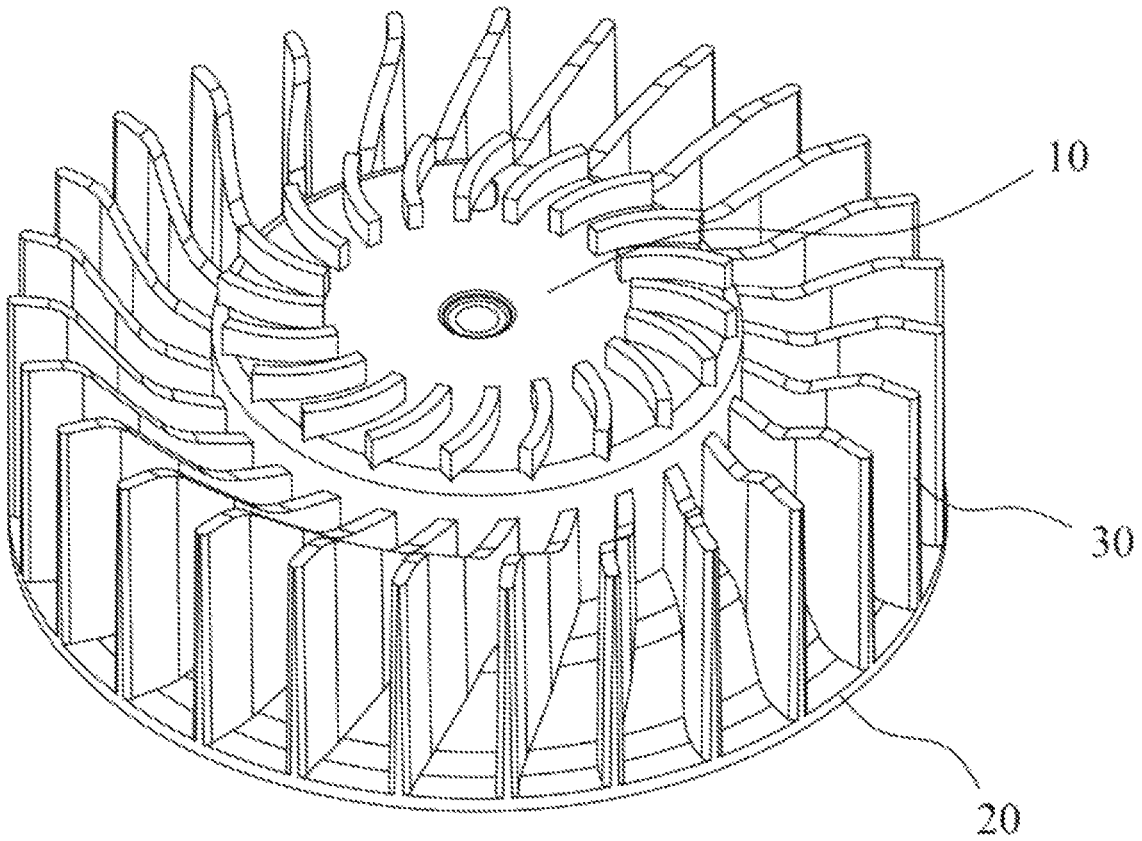
FIG. 11 is a schematic structural diagram of a sixth embodiment of the present disclosure.

As shown in FIG. 11, in a sixth embodiment, the difference between the sixth embodiment and the first and second embodiments lies in that the first blade 30 is connected to the outer peripheral side wall of the wheel hub 10.

Figure 12:
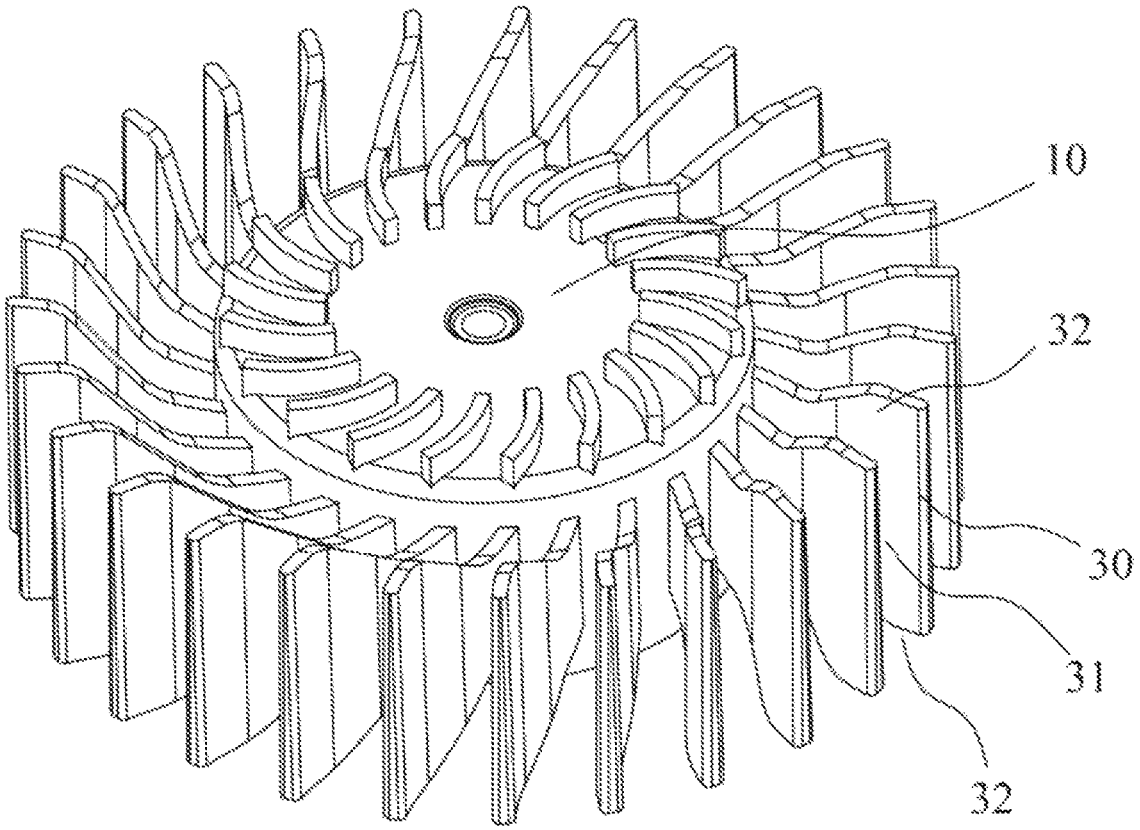
FIG. 12 is a schematic structural diagram of a seventh embodiment of the present disclosure.

As shown in FIG. 12, in a seventh embodiment, the difference between the seventh embodiment and the first and second embodiments lies in that the fan blade includes a wheel hub 10, a plurality of first blades 30 and a plurality of second blades 40, where each of the first blades 30 is connected to the outer peripheral side wall of the wheel hub 10, and both sides of the first air guide groove 31 in the axis direction of the wheel hub 10 both are opened to form the first air inlets 32.

Figure 13:
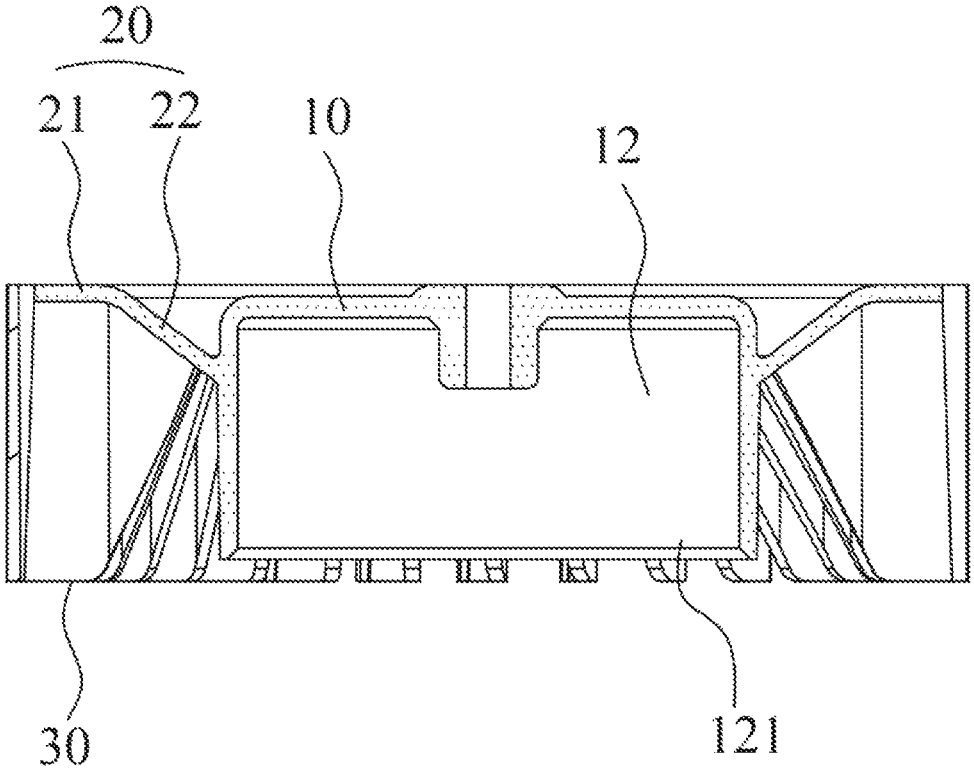
FIG. 13 is a schematic structural diagram of a eighth embodiment of the present disclosure.

As shown in FIG. 13, in an eighth embodiment, the difference between the eighth embodiment and the first and second embodiments lies in that in the first embodiment, the bottom plate 20 is located at an end, close to the mounting opening 121, of the wheel hub 10; in the embodiment, an end, away from the mounting opening 121, of the wheel hub 10 is connected to the bottom plate 20; the first blade 30 extends an opened direction of the mounting opening 121 parallel to the axis direction of the wheel hub 10 from the lower surface of the bottom plate 20; the bottom plate 20 includes the flat plate 21 and the inclined plate 22 integrally connected; the lower end of the inclined plate 22 is connected to the wheel hub 10; the upper end of the inclined plate 22 is connected to the flat plate 21. Specifically, the inclined plate 22 extends toward the direction, close to the wheel hub 10, from top to bottom.

Figure 14:
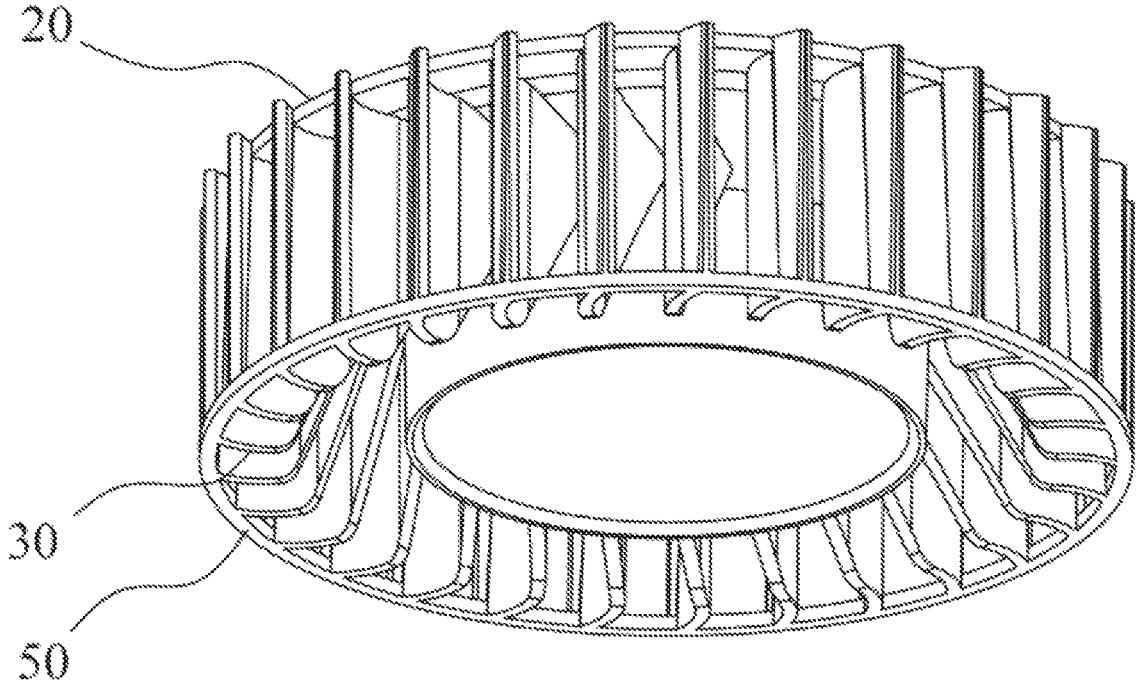
FIG. 14 is a schematic structural diagram of a ninth embodiment of the present disclosure.

As shown in FIG. 14, in a ninth embodiment, the difference between the ninth embodiment and the eighth embodiment lies in that the fan blade further includes a connecting ring 50, the connecting ring 50 being connected to a side, away from the wheel hub 10, at the top end of the first blade 30.

In conclusion, the separation distance is kept between each of the first blades 30 and the wheel hub 10, so that the outer peripheral side wall of the wheel hub 10, the upper surface of the bottom plate 20, and the end, close to the wheel hub 10, of the first blade 30 form the annular groove 11; the side, away from the bottom plate 20, of the first guide air groove 31 is opened to form the first air inlet 32; the side, close to the wheel hub 10, of the first air guide groove 31 is opened to form the second air inlet 33; the second air inlet 33 is connected to the annular groove 11; and the side, away from the wheel hub 10, of the first air guide groove 31 is opened to form the first air outlet 34. When the fan blade rotates, air flows into the first air guide groove 31 from the first air inlet 32 and the second air inlet 33 and flows out from the first air outlet 34. By using the double air inlets, the supply air rate of the fan blade is improved, and the air intake efficiency is higher.

The above is merely the preferred embodiments of the present disclosure and is not intended to limit the present disclosure. Therefore, any modification, equivalent replacement, improvement and the like made on the above embodiments according to the technical reality of the present disclosure shall fall within the scope of the technical solution of the present disclosure.

What is claimed is:

1. A fan blade, comprising a wheel hub, a plurality of first blades and a plurality of second blades, wherein the plurality of first blades encircle an outer peripheral side of the wheel hub at an interval, a first air guide groove is formed between two adjacent first blades, and the first air guide groove is opened in an axis direction of the wheel hub to form a first air inlet;

the plurality of second blades are annularly distributed at an interval on an upper end surface of the wheel hub, a second air guide groove is formed between two adjacent second blades, and a side, away from the upper end surface of the wheel hub, of the second air guide groove is opened to form a third air inlet; and a side, away from the wheel hub, of the first air guide groove is opened to form a first air outlet, and a side, nearer to each of the first blades, of the second air guide groove is opened to form a second air outlet.

2. The fan blade according to claim 1, wherein a quantity of the first blades is ≥a quantity of the second blades.

3. The fan blade according to claim 1, wherein an end, nearer to each of the first blades, of each of the second blades does not protrude out of an outer peripheral side wall of the wheel hub.

4. The fan blade according to claim 1, wherein a separation distance is kept between an end, away from the first blade, of each of the second blades and a central axis of the wheel hub.

5. The fan blade according to claim 1, wherein an upper end surface of each of the first blades protrudes out of the upper end surface of the wheel hub.

6. The fan blade according to claim 1, wherein each of the first blades and each of the second blades both are arc-shaped blades, and bending directions of each of the first blades and each of the second blades are same.

7. The fan blade according to claim 1, wherein a width of the second air guide groove increases gradually from inside to outside.

8. The fan blade according to claim 1, wherein each of the first blades is connected to the outer peripheral side wall of the wheel hub, and both sides of the first air guide groove in the axis direction of the wheel hub both are opened to form the first air inlets.

9. The fan blade according to claim 1, further comprising a bottom plate, wherein a lower end of the wheel hub is connected to the bottom plate; a lower end of each of the first blades is connected to an upper surface of the bottom plate, and each of the first blades is connected to the outer peripheral side wall of the wheel hub; and the side, away from the bottom plate, of the first air guide groove is opened to form the first air inlet.

10. The fan blade according to claim 1, further comprising a bottom plate, wherein a lower end of the wheel hub is connected to the bottom plate; a bottom end of eh gf the first blades is connected to an upper surface of the bottom plate; a separation distance is kept between each of the first blades and the wheel hub; a side, away from the bottom plate, of the first air guide groove is opened to form the first air inlet; an outer peripheral side wall of the wheel hub, the upper surface of the bottom plate and an end, near the wheel hub, of each of the first blades enclose an annular groove; a side, near the wheel hub, of the first air guide groove is opened to form a second air inlet; and the second air inlet is connected to the annular groove.

11. The fan blade according to claim 10, wherein the bottom plate comprises a flat plate and an inclined plate, an upper end of the inclined plate being connected to the wheel hub and a lower end of the inclined plate being connected to the flat plate.

12. The fan blade according to claim 10, wherein the bottom plate is a single inclined plate or arc-shaped plate.

13. The fan blade according to claim 1, wherein a center of circle of an annular structure enclosed by the first blades and a center of circle of an annular structure enclosed by the second blades are on a same axis.

* * * * *